United States Patent [19]

Nivens

[11] Patent Number: 4,936,113

[45] Date of Patent: Jun. 26, 1990

[54] THERMAL INTER-COOLER

[76] Inventor: Jerry W. Nivens, P.O. Box 2045, Truth or Consequences, N. Mex. 87901

[21] Appl. No.: 306,330

[22] Filed: Feb. 3, 1989

[51] Int. Cl.[5] ..... F25B 40/02

[52] U.S. Cl. ..... 62/513; 165/154; 165/164

[58] Field of Search ..... 62/513; 165/154, 164

[56] References Cited

U.S. PATENT DOCUMENTS

| | | | |
|---|---|---|---|
| 2,482,171 | 9/1949 | Gygax | 62/513 |
| 2,520,045 | 8/1950 | McGrath | 62/513 X |
| 2,530,648 | 11/1950 | Cahenzli, Jr. et al. | 62/513 |
| 3,163,998 | 1/1965 | Wile et al. | 62/513 X |
| 3,473,348 | 10/1969 | Bottum | 62/513 |
| 4,030,315 | 6/1977 | Harnish | 62/513 X |
| 4,309,875 | 1/1982 | Radichio | 165/154 X |

*Primary Examiner*—William E. Tapolcai
*Attorney, Agent, or Firm*—Thomas D. Copeland

[57] ABSTRACT

A non-restrictive, constant pressure refrigerant recycling and cooling unit that interrupts the normal refrigerant cycle to permit a lower temperature liquid to enter the expansion device, and thus provide a lower temperature, and therefore a lower pressure gas for delivery to the inlet side of the compressor, which acts to reduce the energy requirement and cost to operate the compressor. This reduction in pressure and temperature also results in lower operating costs and lower maintenance costs and utilizes less refrigerant quantity requirements. A key factor in attaining the above advantages is the construction of the thermal inter-cooler that is so made that no restrictions are specifically inserted in the inter-cooler system, and that direct physical contact exists between the metal compressor inlet suction line and the metal (Cu) refrigerant hot line for optimum heat transfer, and as a result an increased volumetric efficiency and increased capacity occurs by a lowering of the pressure on both sides of the compressor.

5 Claims, 2 Drawing Sheets

THERMAL INTER-COOLER

BACKGROUND OF THE INVENTION

1. Field of the Invention

This invention relates to a thermal inter-cooler for use in any type of refrigeration system that employs a liquid and gas refrigerant. In most instances, similar systems would employ a compressor to compress and pressurize a refrigerant gas, such as freon, which would then be condensed into a partial liquid and gaseous state, and be directed into a housing through a series of restricted nozzles, where it would expand and cool and experience a pressure drop and then recondense as a somewhat denser liquid in the bottom of the housing before exiting through the outlet on its way to an expansion valve ahead of the evaporator, whereat the refrigerant enters the expansion device as a somewhat cooler liquid, but also as an imperfect liquid and gas mixture in prior systems.

2. Brief Description of the Prior Art

Many prior attempts have been made to create an efficient and economical subcooler for use in refrigeration systems, but each has included certain drawbacks and limitations in their performance, such as intentionally inserted restrictions, i.e., nozzles that restrict and interrupt the smooth flow of refrigerant and create a larger than necessary back pressure. The present invention includes improved structural and conceptual parts that permit its performance and results to approach the optimun for the purpose intended.

In U.S. Pat. No. 4,207,749, to Lavigne, entitled Thermal Economized Refrigeration System, employs a series of nozzles to deliberately maintain a pressure drop in his refrigerant line, and his condenser and economizer each require a separate source of cool fluid to circulate therethrough.

U.S. Pat. No. 4,683,726, to Barron, entitled Refrigeration Apparatus also requires the use of a plurality of restrictive nozzles in his subcooler, and further requires that his subcooler be located in the cold air stream from the evaporator.

The Kann U.S. Pat. No. 4,773,234, also includes flow restricting nozzles to intentionally produce a pressure drop between the subcooler and the receiver.

In contrast to these and other prior art patents, this Applicant does not intentionally insert any restrictions into his refrigerant flow system, but permits his direct metal to metal contact between the refrigerant line and a cooler line in the system to provide temperature reduction required for his efficient operation.

SUMMARY OF THE INVENTION

An object of this invention is to provide a structure for a refrigeration system thermal "intermediate" cooler that does not include any imposed restrictions in the refrigerant path through the system that would physically cause a pressure drop across this unit.

Another object is to provide a heat transfer path for the refrigerant to traverse that provides a substantial length and area of metal to metal contact between the line carrying the hot refrigerant liquid and the line carrying the cool expanded refrigerant gas.

A further object is to provide a dual stage cooler for the hot refrigerant gas without the inclusion of any inserted physical restrictions in the refrigerant line.

Yet another object of this invention is to provide a device of this type comprising a cooling shell into which the liquid and gas refrigerant expands and permits liquid only to collect in the lower portion of the shell and be withdrawn to feed into an expansion device in a condition known in the trade as a "liquid seal".

And another object is to provide a device of the previous object in which the inter-cooler will perform without appreciable drop in performance even when the shell is filled with liquid or when it is three-fourth empty of liquid.

DESCRIPTION OF PREFERRED EMBODIMENTS

Figure 1:
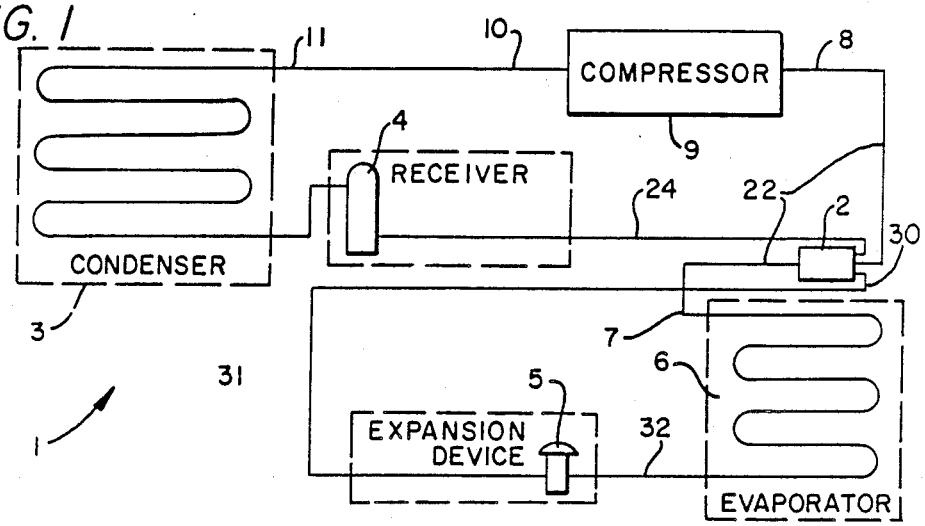
FIG. 1 is a schematic diagram of a typical refrigerant system which employs the thermal inter-cooler of this invention.

Referring now more particularly to the characters of reference of the drawing, it will be observed that FIG. 1 schematically depicts a refrigeration system 1 including the thermal inter-cooler 2 of this invention interposed between the condenser 3, the optional receiver 4, and the expansion device 5 at the evaporator 6, and wherein the outlet line 7 from the evaporator passes through the cooler 2 and thence to the inlet or suction side 8 of the compressor 9. The low pressure, low temperature refrigerant gas from the evaporator 6 (through the inter-cooler 2) enters the compressor at 8 in a relatively low temperature, low pressure state, and then exits the compressor at line 10 in a relatively hotter temperature and relatively higher pressure when it enters the condenser 3 at inlet 11.

Figure 2:
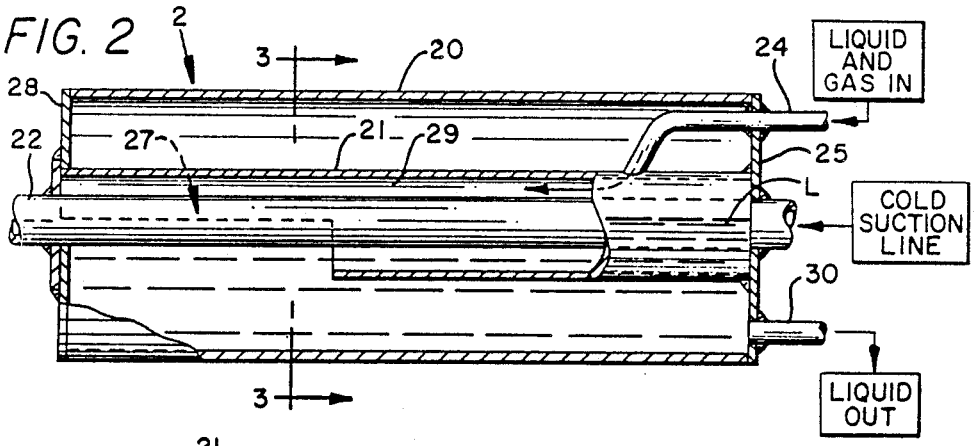
FIG. 2 is a partially sectioned view of one embodiment of the inter-cooler of this invention.

In FIG. 2, the first embodiment of the thermal condenser 2 is seen to comprise an outer shell 20 of a good thermal conducting metal such as aluminum, copper, steel, or other known materials. The large central axial piper or tube 21 is of a smaller diameter than the shell 20, and may be concentrically installed therein. Another good heat conducting material tube 22 extends axially and also concentrically through the shell 20 and pipe 21 and comprises the outlet line 7 that traverses from the evaporator 6 to compressor inlet 8. The inlet line 24 from the condenser/receiver enters through the right end plate 25 of cooler 2, and engages the top side of pipe 21 in such a manner that fluid travelling through the line 24 expands into the annular space 29 between pipe 21 and tube 22 until it exits at the cutaway portion 27 before reaching left end plate 28. Upon exiting from the annulus 29, any entrapped gas condenses into liquid and combines with the liquid in the line and fills the lower portion of shell 20 and exits therefrom through outlet 30 as a "liquid seal" L, without entrapped gas. This total condensation is due in part to the expansion of the mixture out through the cutaway 27, and in part due to the close contact with the cold suction line 22, and in part to contact of the fluid with the inner wall of the she11 20, which is installed in a cold ambient location.

Liquid refrigerant proceeds from outlet 30 through line 31 to expansion device 5, which is normally a valve, and through line 32 to evaporator 6, wherein the liquid is converted into a lower temperature and lower pressure gas that passes through cooler 2 via tube 22 on its way to the suction side of compressor 9 via its intake opening 8. The utilization by the compressor 8 of a lower than the normal intake pressure (and temperature) will result in a lower power requirement by the compressor, which translates into greater efficiency and lower cost, and this feature has been confirmed by tests and charts of "before" and "after" installations.

Figure 3:
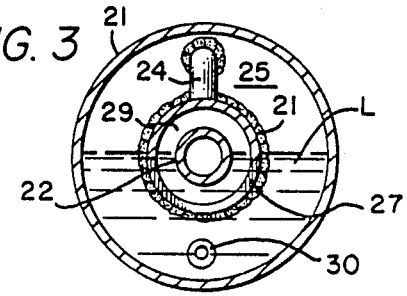
FIG. 3 is a cross-section taken along the lines 3—3 of FIG. 2.

In FIG. 3, the liquid L is shown to have a liquid level slightly above the centerline of the concentric structures. It has been found, however, that this inter-cooler 2 will function very satisfactorily when the liquid level is in the range from 100% full to 75% empty. The dimensional difference between the inner diameter of pipe 21 and the outer diameter of tube 22, is of the order of one-eighth of an inch in one preferred embodiment, so that inlet fluid in the annular space 29 is in a very efficient heat transferring relationship with cold tube 22, pipe 21 and the cooler liquid L.

Figure 4:
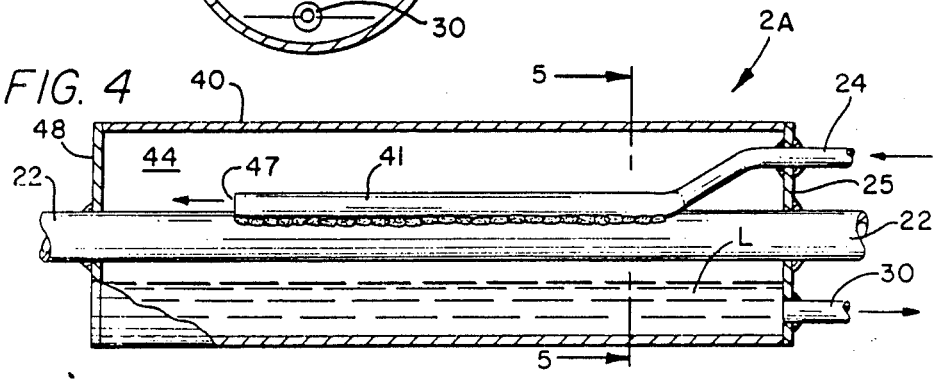
FIG. 4 is a cross-sectional view of a second embodiment of this invention.
Figure 5:
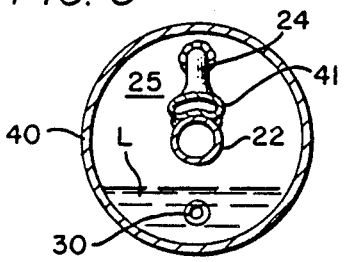
FIG. 5 is a cross-section taken along the lines 5—5 of FIG. 4.

FIG. 4 represents a preferred embodiment of this thermal inter-cooler 2A, wherein the inlet line 24 converts into an expanded generally oval shaped tube 41, with open end 47 to permit exit of the entering gas and liquid to spray into the open area 44 of shell 40, whereupon any gas in the entering mixture condenses upon contact with the cold tube 22, the cool inner wall of shell 40, and end walls 48 and, or the cooler liquid L, so that the exiting fluid at 30 will be a "liquid seal", identified here as L. The long extended metal to metal contact between tube section 41 and the cold center tube 22 may best be seen in FIG. 5. This intimate continuous conntact for a considerable length is a key reason for the success of this particular embodiment over the prior art. A non-analogous comparison of this phenomenon, is that the heat in the hot refrigerant tube 24 appears to be magnetically attracted into the cold suction tube 22. End plate 48 of this embodiment snugly surrounds the exiting cold tube 22, as contrasted to the end plate 28 of embodiment 2.

Figure 6:
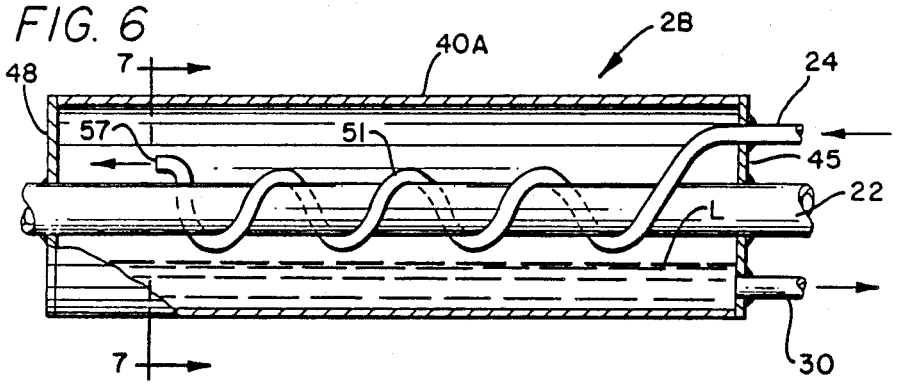
FIG. 6 is a cross-sectional view of a third embodiment of this invention.

Embodiment 2B of FIG. 6 differs from the embodiments of FIGS. 2 and 4, in that it provides for a much longer travel path for the incoming fluid mixture via line 24 that is spirally would at 51 around the center cold tube 22, before the fluid exits at 57 as a mixture of gas and liquid into the large open interior enclosed by shell 40A and end plates 48 and 45. The gas content of the exiting fluid immediately condenses on contact with the inner wall of shell 40A, end plates 45 or 48, the cold center tube 22, or the cooler liquid L in the lower area of shell 40A. The liquid seal L exiting at 30, proceeds through line 31 to expansion divice 5 to rejoin the total refrigeration system 1.

Figure 7:
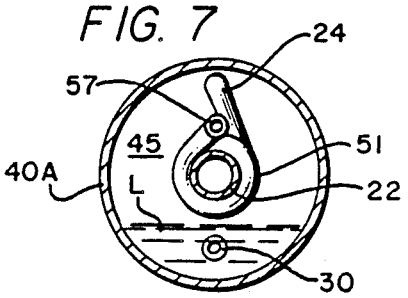
FIG. 7 is a cross-section taken along the lines 7—7 of FIG. 6.

FIG. 7 is an axial section showing the interior of embodiment 2B of FIG. 6. The spiral configuration 51 of fluid inlet tube 24 entering into the shell 40A is determined by weighing the factors of providing the maximum area of heat transfer contact against the increased friction imposed in the travel path of the incoming fluid through a long and tortuous route to reach exit 57. This, of course, is one of the advantages of the embodiment 2A, which utilizes a long but straight travel path to its exit 47.

Figure 8:
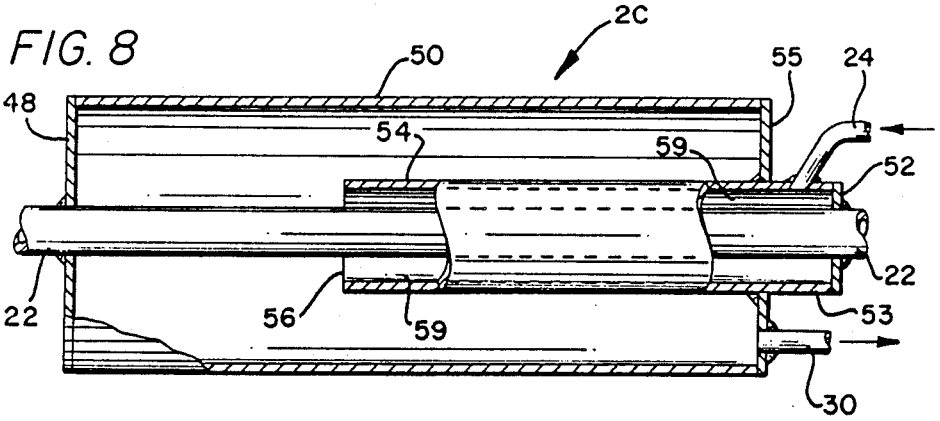
FIG. 8 is a partially cross-sectioned view of a fourth embodiment of this invention.

In FIG. 8, the details of embodiment 2C may be observed to include an outer shell 50 having end plates 48 and 55, which permit the passage therethrough of center cold tube 22. End plate 55, additionally permits the entrance and passage of pipe 51 concentrically of both shell 50 and center tube 22. End plate is attached by welding or otherwise to extension 53 and end plate 52 is likewise attached to tube 22 to provide an enclosure seal for fluid entering through tube 24. The incoming fluid fills the annular region 59 of the cantilever suspended pipe 54, and proceeds to the open exit end 56, whereupon it expands and any gas therein condenses and fills the lower part of shell 50 with liquid seal (not shown in this view), as a portion of said liquid seal exits through outlet tube 30 back into the refrigeration cycle.

It should be understood that this invention is not limited to the described embodiments disclosed herein, except as their structure and function fall within the scope of the appended claims.

What is claimed is:

1. In a refrigeration system complete with compressor, condenser, expansion device, and evaporator, employing less than a full amount of refrigerant, the improvement comprising:

(a) the addition of a thermal inter-cooler, between said condenser and said expansion device and between said evaporator and said compressor, having an outer shell, (b) said inter-cooler and associated connections having no inserted restrictions to fluid flow therethrough, (c) a cold suction line running from the output side of said evaporator to the input side of said compressor and carrying cooler than ambient refrigerant gas, (d) said suction line passing axially through said thermal inter-cooler, (e) a hot refrigerant gas line running from the output side of said compressor to the input side of said condenser, (f) a hot refrigerant gas and liquid line running from the output side of said condenser to the input side of said thermal inter-cooler and overlaying said suction line in an axial direction within said outer shell, (g) the direction of flow of fluid in said gas and liquid line being opposite the flow of fluid through said suction line, and (h) an exit opening a the distal end of said gas and liquid line, whereby the gas and liquid fluids spray into the interior of said shell and collect in the bottom of said shell as liquid only and at a substantially reduced temperature and pressure prior to exiting to said expansion device thereby reducing the load and power requirements on said compressor and system.

2. A thermal inter-cooler as in claim 1, wherein said gas and liquid inlet line attaches to and conforms in part to the shape of said suction line.

3. In a refrigeration system complete with compressor, condenser, expansion device, and evaporator, employing less than a full amount of refrigerant, the improvement comprising:

(a) the addition of a thermal inter-cooler, between said condenser and said expansion device and between said evaporator and said compressor, having an outer shell, (b) said inter-cooler and associated connections having no added restrictions to fluid flow therethrough, (c) a cold suction line running from the output side of said evaporator to the input side of said compressor and carrying cooler than ambient refrigerant gas, (d) said suction line passing longitudinally through said thermal inter-cooler, (e) a hot refrigerant gas line runnning from the output side of said compressor to the input side of said condenser, (f) a hot refrigerant gas and liquid line running from the output side of said condenser to the input side of said thermal inter-cooler and at least partially surrounding said suction line in an axial direction within said outer shell, (g) an exit opening at the distal end of said gas and liquid line, whereby the gas and liquid fluids spray into the interior of said shell and collect in the bottom of said shell as a liquid seal at a substantially reduced temperature and pressure prior to exiting to said expansion device thereby reducing the load and power throughout the refrigeration system.

4. A thermal intercooler as in claim 3, having no restrictive functional devices in any external connecting line thereto.

5. A thermal inter-cooler as in claim 3, functioning as a means to allow said undercharged refrigerant system to operate in a normal manner, without adverse side effects.

* * * * *